US005215133A

United States Patent [19]

Lambert

[11] Patent Number: 5,215,133

[45] Date of Patent: Jun. 1, 1993

[54] DEVICE FOR SUPPORTING A LIQUID CONTAINER

[76] Inventor: William S. Lambert, 52 Tokalon Pl., Metairie, La. 70001

[21] Appl. No.: 767,421

[22] Filed: Sep. 30, 1991

Related U.S. Application Data

[63] Continuation of Ser. No. 598,143, Oct. 16, 1990, abandoned.

[51] Int. Cl.[5] ..... B65B 1/04

[52] U.S. Cl. ..... 141/364; 141/376; 222/181

[58] Field of Search ..... 222/181, 185; 141/106, 141/313, 376, 364, 375; 248/305, 103

[56] References Cited

U.S. PATENT DOCUMENTS

| | | | |
|---|---|---|---|
| 2,608,843 | 9/1952 | Kennedy | 141/364 X |
| 2,696,336 | 12/1954 | Van Drunen | 141/376 X |
| 3,654,969 | 4/1972 | Vazquez et al. | 141/106 |
| 4,271,878 | 6/1981 | Bologa | 141/375 |
| 4,399,847 | 8/1983 | McRoberts | 141/364 |
| 4,998,647 | 3/1991 | Sharp | 222/181 X |
| 5,052,149 | 10/1991 | Johnson | 222/181 X |
| 5,080,150 | 1/1992 | Deadwyler, Jr. | 141/364 |
| 5,105,860 | 4/1992 | Connor | 141/364 X |

*Primary Examiner*—Gregory L. Huson
*Attorney, Agent, or Firm*—Keaty & Keaty

[57] ABSTRACT

The device of the present invention is intended to temporarily support upended liquid containers for the purpose of absolute evacuation and reclamation of any and all residual liquid content remaining therein. The device has a funnel-shaped retaining body which has a wider open top and a smaller diameter open bottom. A non-continuous side wall has an elongated opening therein which, due to resiliency of the material from which the retaining body is constructed, allows a limited expansion or contraction of the retaining body depending on the size of a liquid container positioned therein. A hook-shaped attachment rod allows to suspend a retaining body from a stationary support.

5 Claims, 1 Drawing Sheet

DEVICE FOR SUPPORTING A LIQUID CONTAINER

This is a continuation of U.S. Ser. No. 07/598,143, now abandoned, filed Oct. 16, 1990.

BACKGROUND-FIELD OF INVENTION

This invention is in the field of waste-prevention and maximum utilization of every last drop of the contents of a vessel containing a liquid intended to be evacuated for utilization.

BACKGROUND-DESCRIPTION OF PRIOR ART

Historically, most persons are unable to, or are unwilling to put forth the effort to salvage any liquid residue remaining in a liquid container thus wasting the value and utilization of an immeasurably huge cumulative quantity of that unused refined liquid content.

OBJECTS AND ADVANTAGES

The object of this invention is waste prevention in concert with maximum utilization of the residual liquids remaining in their original vessels and unused and discarded by the individuals, businesses, and institutions. Viewed collectively, a staggering quantity of perfectly good, uncontaminated, refined liquids are daily squandered. And in even some cases, our nations' (and the worlds') rapidly escalating garbage dilemma is further tainted and multiplied by this shameful waste. One is easily shocked to contemplate the cumulative, total quantities of all kinds of such liquids remaining in these vessels and discarded. Some examples so remaining are, but of course, not limited to household, institutional, industrial, military, etc., liquids comprising soaps, oils, various additives, etc., of varying film thicknesses, consistencies, fluidity, as may remain attached to the containers' inner wall surfaces. Owing to individual viscosities, slow moving contents can be utilized more quickly by upending the vessel to speed the liquid to the discharge spout. The typical, hurried consumer give no thought to the utilization of this residue by upending the container and waiting for its eventual total evacuation. In the expediency of today's throw-away mentality, the user does just that.

The device of the present invention allows for the upending and settlement/accumulation of this remaining fluid. Evacuation, and utilization of this quantity is accomplished by upending, reopening the container by uncapping, or using the common flip/spigot to drain that last drop. In the case of a container requiring puncture, such as the typical can of motor oil, the can is upended, cocked on an angle with the puncture/opening arranged uppermost (to avoid spillage) and the residue having gravitationally collected, the vessel is rotated, puncture hole now lowermost, and evacuated. The device of the present invention contemplates provision of a device for supporting and retaining a liquid container either having an open neck closed by a removable cap or a punctured opening for gravitational collection and eventual evacuation of the residual liquid contained in the liquid container. The device comprises a funnel-shaped retaining body which has an open top and an open bottom, means for suspending the retaining body from a stationary support. The retaining body is provided with means for expanding a diameter of the retaining body depending on the size of the liquid container positioned therein.

The means for expanding the retaining body comprises a non-continuous side wall of the retaining body which is formed from a resilient (such as plastic) material and is provided with an opening extending from a top edge to a bottom edge of the body. The opening is forced to expand or allowed to contract depending on the size of the liquid container positioned within the retaining body and forcing the opening to expand under the influence of the liquid container size.

In a preferred method, a liquid container, for example, a shampoo bottle, is turned upside down and retained, while tightly capped, for any desired time to allow the liquid within the container to move by gravity to the open top and be ready for dispensing once the bottle is removed from the funnel and the cap is opened.

The applications for this device, in various sizes, is without limit. Beside the uses previously cited, it would serve in the home kitchen, bath, garage, etc. One consumer-oriented embodiment would be for use in the shower/bath compartment during bathing. The device of the present invention could be used to fully discharge the upended containers of such relatively expensive fluids such as liquid soaps, shampoos, hair rinses, conditioners, etc., tub-cleansing liquids, etc.—a helping hand, so to speak. Exact dimensions to be determined by uses intended and manufacturing criteria.

DETAILED DESCRIPTION OF THE PREFERRED EMBODIMENT

Figure 1:
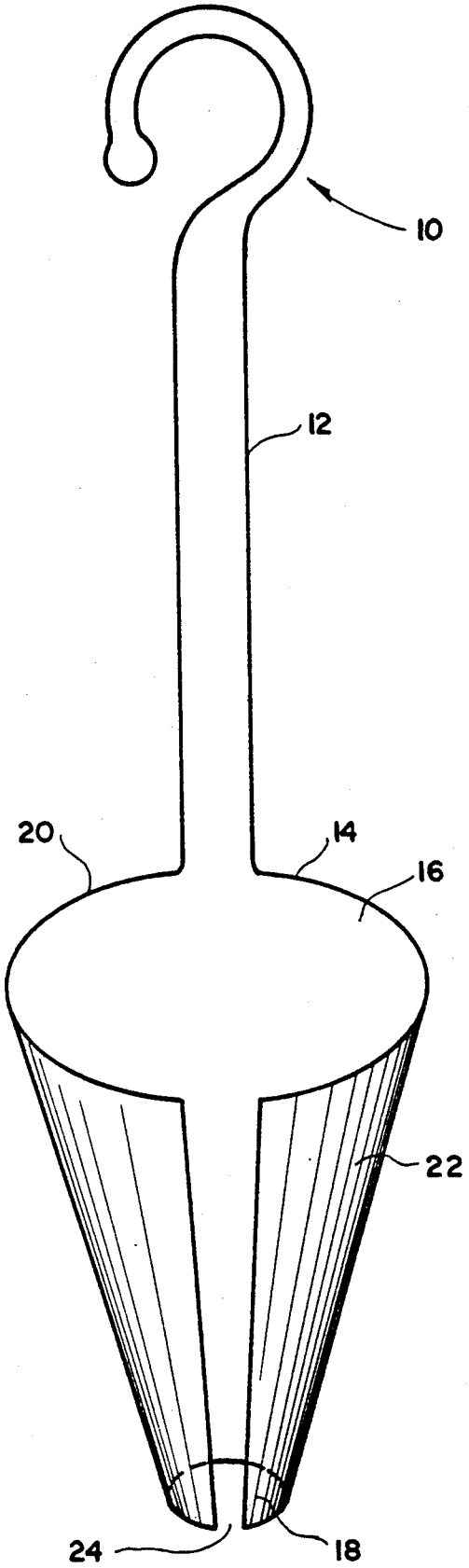
FIG. 1 is a perspective view of the device of the present invention.
Figure 1A:
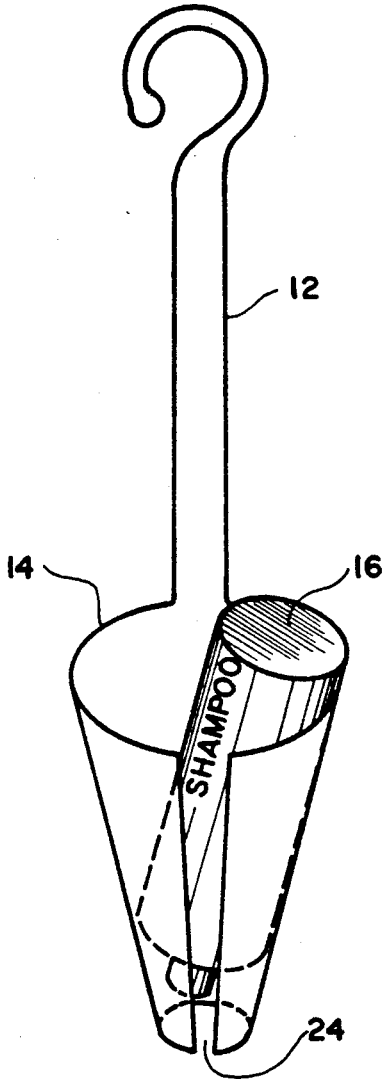
FIG. 1*a* is a perspective view similar to FIG. 1, but having an exemplary liquid container positioned in the retaining body.

The unit is a plastic-cast single element comprising the hook-shaped attachment means 10, the support having an elongated shaft 12, and a retaining body 14. Construction is of plastic, heat/stamp/cast formation as illustrated, utilizing an appropriately formulated, durable plastic material in thicknesses proportional to requirements. The device for supporting and retaining a liquid container in accordance with the present invention comprises the retaining body 14 which is generally funnel-shaped and has a wider open top 16 and a smaller diameter open bottom 18. As can be seen in FIGS. 1 and 1*a*, the elongated shaft 12 is integrally attached to the retaining body 14 at an uppermost edge 20 and extends upwardly therefrom in a co-alignment with a side wall 22 of the retaining body 14. The side wall 22 is a non-continuous wall having an opening 24 therein extending from the terminal bottommost portion of vessel retaining body 14. As a result, the retaining body 14 and more particularly side wall 22 is separated longitudinally, from top to bottom to allow for expansion/contraction accommodation of circumference variation in the vessels. The very bottom of the retaining body 14 is a circular aperture to allow protrusion of the vessel/container neck/spigot to facilitate total content evacuation therefrom.

OPERATION OF THE INVENTION

The attachment hook 10 is secured over a stationary body such as for example, a towel bar. After allowing time for settlement/consolidation of the liquid residue in a liquid container bottle, for example shampoo bottle 16 (see FIG. 1*a*), the bottle 16 is removed (maintaining the upended positioning) for total evacuation/utilization or left in retaining body 14 and remaining liquid evacuated therefrom.

Other liquid containers can be similarly positioned and retained within the device of the present invention. If, for example, an oil can needs to be drained of the last residue of oil, it is positioned, at an angle, similarly to the illustration of the FIG. 1*a*, but in such a manner that the opening made in a conventional manner in a top of the oil can faces upwardly, preventing the oil from contaminating the wall 22 of the device of the present invention and premature evacuation of the oil. In this manner, the oil flows, by gravity, into a side of the oil can and when the oil can is turned upside down, the residual contents of the can are much more easily evacuated.

As will be appreciated, provision of the resiliently expandable side wall 22, having an opening 24 therein, allows for a limited expansion of the diameter of the funnel-shaped retaining body 14, so as to accommodate the various diameter liquid containers, and after a larger size container is removed from the retaining body 14, the body contracts reducing the size of the opening 24 under the resiliency of the material from which the retaining body is formed. As was mentioned above, one of the materials which could be utilized for the purposes of manufacturing the device of the present invention is a resilient plastic having the desired physical properties.

CONCLUSION

While a shower/bath utilization was principally discussed, variable sizes and strengths allow for unlimited utilization. In the kitchen, various related liquids can be completely drained and used, in mechanical-related shops, various oils, additives, etc., etc. can be utilized maximally. Institutions like hospitals use a multitude of liquids that can likewise be so efficiently treated. Ones' imagination is the singular limitation to multitudinous utilization.

I claim:

1. A device for supporting and retaining a liquid container having an open top, comprising:

a funnel-shaped retaining body having an open top defined by an upper edge and an open top defined by a lower edge, said body being formed by a resiliently expandable wall having an elongated opening extending from the upper edge to the lower edge, and wherein expansion of the opening causes expansion of the diameter of the retaining body to accommodate different size liquid containers positioned within the retaining body; and means for suspending the retaining body from an external independent stationary support.

2. The device of claim 1, wherein said means for suspending comprises a hook-shaped attachment rod integrally connected to the upper edge of the retaining body and extending upwardly therefrom.

3. The device of claim 2, wherein said attachment rod is secured to the retaining body at a location diametrically opposite said elongated opening.

4. A device for supporting and retaining a liquid container having an open top, comprising:

a funnel-shaped retaining body having an open top, an open bottom end and a non-continuous side wall, said side wall being provided with an elongated opening which extends from a top edge to a bottom edge of the retaining body, such that expansion of the elongated opening causes expansion of the diameter of the retaining body to allow a limited expansion and contraction of the side wall under force exerted by a liquid container positioned in the retainer body;

a means for suspending the retaining body from a stationary support, said suspending means comprising an elongated rod integrally attached to a top edge of the retaining body at a location diametrically opposite said elongated open an a hook-shaped end integrally formed with an elongated attachment rod.

5. The device of claim 4, wherein said attachment rod extends outwardly from a top edge of said retaining body.

* * * * *